US010400604B2

(12) United States Patent
Sawada

(10) Patent No.: US 10,400,604 B2
(45) Date of Patent: Sep. 3, 2019

(54) AXIAL FAN WITH GROOVED TRAILING EDGE AND OUTDOOR UNIT

(71) Applicant: FUJITSU GENERAL LIMITED, Kanagawa (JP)

(72) Inventor: Hirotaka Sawada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 15/660,067

(22) Filed: Jul. 26, 2017

(65) Prior Publication Data

US 2018/0066521 A1 Mar. 8, 2018

(30) Foreign Application Priority Data

Sep. 2, 2016 (JP) ..... 2016-172138
Sep. 2, 2016 (JP) ..... 2016-172139

(51) Int. Cl.
*F01D 5/00* (2006.01)
*F01D 5/14* (2006.01)
(Continued)

(52) U.S. Cl.
CPC ..... *F01D 5/141* (2013.01); *F01D 5/16* (2013.01); *F04D 29/384* (2013.01);
(Continued)

(58) Field of Classification Search
CPC . F01D 5/141; F01D 5/16; F01D 5/146; F04D 29/384; F04D 29/681; F24F 1/0029;
(Continued)

(56) References Cited

U.S. PATENT DOCUMENTS 4,089,618 A * 5/1978 Patel ..... F04D 29/668 416/228
4,497,613 A * 2/1985 Carreno ..... F01D 5/16 416/228
(Continued)

FOREIGN PATENT DOCUMENTS

CN 102 588 339 A 7/2012
JP H02-061400 A 3/1990
(Continued)

OTHER PUBLICATIONS

Extended European Search Report issued in corresponding EP Patent Application No. 17184976.3, dated Jan. 25, 2018.

*Primary Examiner* — Travis C Ruby
(74) *Attorney, Agent, or Firm* — McDermott Will & Emery LLP

(57) ABSTRACT

An axial fan includes: a hub; a plurality of blades arranged in a circumferential direction of the hub; a cutout in a rear edge part of each of the plurality of blades, the cutout divides the rear edge part into an outer rear edge part and an inner rear edge part; a first groove part disposed in the outer rear edge part, the first groove part including a plurality of grooves extending toward the front edge part; and a second groove part disposed in the inner rear edge part, the second groove part including a plurality of grooves extending toward the front edge part, the plurality of grooves of the first groove part and the plurality of grooves of the second groove part having different shapes when viewed in a rotational axis direction of the hub.

10 Claims, 8 Drawing Sheets

(51) Int. Cl.

| | |
|---|---|
| ***F01D 5/16*** | (2006.01) |
| ***F24F 1/0029*** | (2019.01) |
| ***F24F 13/24*** | (2006.01) |
| ***F04D 29/38*** | (2006.01) |
| ***F04D 29/68*** | (2006.01) |

(52) U.S. Cl.
CPC ..... *F04D 29/681* (2013.01); *F24F 1/0029* (2013.01); *F24F 13/24* (2013.01); *F05D 2240/304* (2013.01); *F05D 2250/181* (2013.01); *F05D 2250/182* (2013.01); *F05D 2250/183* (2013.01); *F05D 2250/184* (2013.01); *F05D 2300/43* (2013.01)

(58) Field of Classification Search
CPC ..... F24F 13/24; F05D 2240/304; F05D 2250/181; F05D 2250/182; F05D 2250/183; F05D 2250/184; F05D 2300/43
See application file for complete search history.

(56) References Cited

U.S. PATENT DOCUMENTS 5,074,376 A * 12/1991 Powell ..... B63H 1/28 181/277
5,603,607 A * 2/1997 Kondo ..... F04D 29/384 415/119
2007/0031257 A1* 2/2007 Suzuki ..... F04D 29/384 416/182
2010/0260608 A1* 10/2010 Suzuki ..... F04D 29/326 416/204 R
2012/0031591 A1* 2/2012 Eguchi ..... F04D 29/384 165/121
2012/0207606 A1* 8/2012 Stephan ..... F04D 29/384 416/204 R
2013/0126134 A1* 5/2013 Park ..... F04D 5/00 165/121
2013/0323098 A1* 12/2013 Ooya ..... F04D 29/384 417/410.1
2014/0363306 A1* 12/2014 Kojima ..... F04D 29/384 416/242
2015/0003992 A1 1/2015 Kojima et al.
2015/0152875 A1 6/2015 Kamiya et al.
2015/0240645 A1* 8/2015 Yokose ..... F04D 29/667 416/223 R

FOREIGN PATENT DOCUMENTS

JP 08-189497 A 7/1996
JP 5252070 B2 4/2013

* cited by examiner

AXIAL FAN WITH GROOVED TRAILING EDGE AND OUTDOOR UNIT

CROSS-REFERENCE TO RELATED APPLICATION

This application claims priority from Japanese Patent Application Nos. 2016-172138 and 2016-172139 filed with the Japan Patent Office on Sep. 2, 2016, the entire contents of which are hereby incorporated by reference.

BACKGROUND

1. Technical Field

The present disclosure relates to an axial fan and an outdoor unit.

2. Description of the Related Art

There has been an axial fan as below (for example, Japanese Patent No. 5252070). The axial fan includes blades each having a rear edge part (in a rotational direction of the blade) having a cutout extending toward a front edge part of the blade. The rear edge part is divided by the cutout into an outer rear edge part (a rear edge part closer to an outer circumference of the blade) and an inner rear edge part (a rear edge part closer to an inner circumference of the blade). In such an axial fan, a vortex that has occurred in the front edge part of the blade is flown from the front edge part to the rear edge part along a blade surface of the blade, and is then caught and held by the cutout. This suppresses or reduces fluctuation and development of the vortex, thereby suppressing or reducing a noise caused by the flow of the air.

There has been known another type of axial fan according to a related art (for example, JP-A-8-189497) including blades each having a rear edge part having a plurality of grooves extending from the rear edge part toward a front edge part of the blade. In the axial fan, a vortex that has occurred in the rear edge part of the blade is finely divided for reducing a noise caused by the flow of the air.

SUMMARY

An axial fan includes: a hub; a plurality of blades arranged in a circumferential direction of the hub; a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part; a first groove part disposed in the outer rear edge part along the outer rear edge part, the first groove part including a plurality of grooves penetrating through the each of the plurality of blades in a thickness direction of the each of the plurality of blades, the plurality of grooves extending toward the front edge part; and a second groove part disposed in the inner rear edge part along the inner rear edge part, the second groove part including a plurality of grooves penetrating through the each of the plurality of blades in a thickness direction of the each of the plurality of blades, the plurality of grooves extending toward the front edge part, the plurality of grooves of the first groove part and the plurality of grooves of the second groove part having different shapes when viewed in a rotational axis direction of the hub.

DESCRIPTION OF THE EMBODIMENTS

Figure 1:
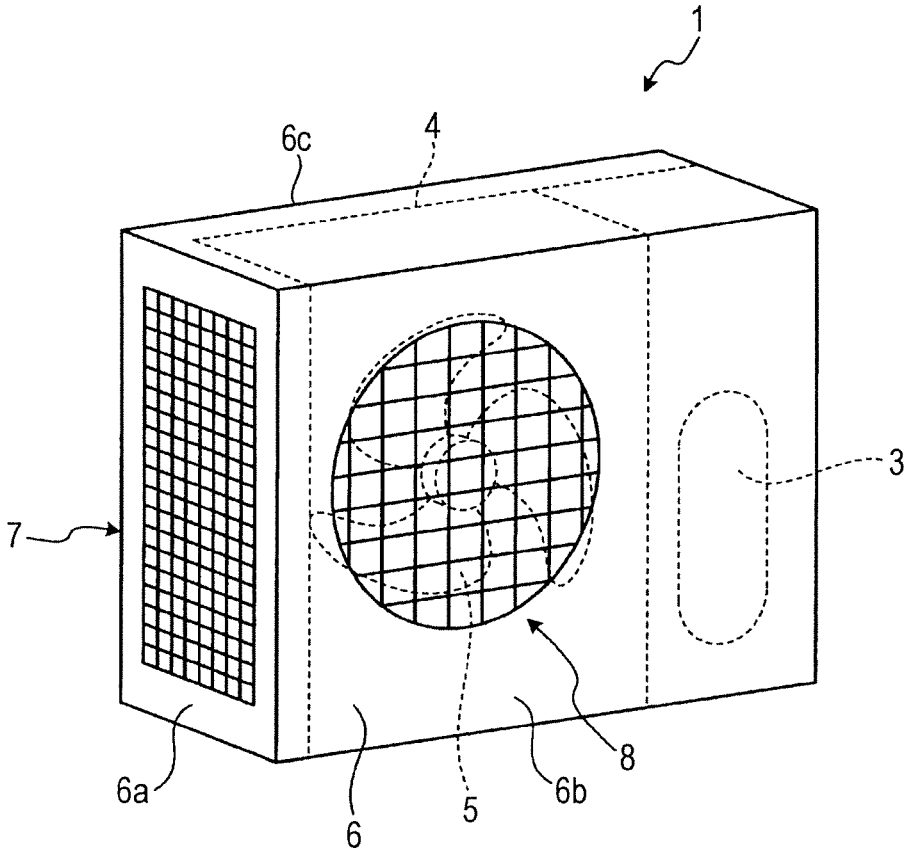
FIG. 1 is a diagram schematically illustrating an outdoor unit according to an embodiment of the present disclosure including an axial fan.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically illustrated in order to simplify the drawing.

Incidentally, with the axial fan including the blades each having the rear edge part having the cutout, a wind speed in the inner rear edge part tends to be lower than a wind speed in the outer rear edge part. In order to deal with this, for the configuration having a groove in the outer rear edge part, the groove extending from the rear edge part toward the front edge part is designed to have an increased depth according to the wind speed in the outer rear edge part. This enhances the effect of reducing the noise. However, increasing the depth of the groove leads to a reduction in mechanical strength of the outer rear edge part. For this reason, in some cases, it may be difficult to secure an adequately deep depth for the groove according to the wind speed. In addition, in the axial fan, as the wind speed becomes lower, a flow of air over the blade surface is more likely to be affected by a centrifugal force caused by rotation of the blades. Due to the effect of the centrifugal force, an airflow direction in the inner rear edge part and an airflow direction in the outer rear edge part become different from each other. Therefore, if the groove in the rear edge part in the above-described configuration is not formed to extend along the airflow direction, the effect of reducing a noise caused by the flow of the air cannot be achieved adequately.

An object of the technique according to the present disclosure is to provide an axial fan capable of suppressing or reducing a noise caused by a flow of air and an outdoor unit including the axial fan.

Another object of the technique according to the present disclosure is to provide an axial fan including a rear edge part securing a proper mechanical strength and an outdoor unit including the axial fan.

An axial fan according to a first aspect of the present disclosure includes: a hub; a plurality of blades arranged in a circumferential direction of the hub; a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part; a first groove part disposed in the outer rear edge part along the outer rear edge part, the first groove part including a plurality of grooves penetrating through the each of the plurality of blades in a thickness direction of the each of the plurality of blades, the plurality of grooves extending toward the front edge part; and a second groove part disposed in the inner rear edge part along the inner rear edge part, the second groove part including a plurality of grooves penetrating through the each of the plurality of blades in a thickness direction of the each of the plurality of blades, the plurality of grooves extending toward the front edge part, the plurality of grooves of the first groove part and the plurality of grooves of the second groove part having different shapes when viewed in a rotational axis direction of the hub.

An axial fan according to a second aspect of the present disclosure includes: a hub; a plurality of blades arranged in a circumferential direction of the hub; a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part; a first groove part disposed in the outer rear edge part along the outer rear edge part, the first groove part including a plurality of grooves penetrating through the each of the plurality of blades in a thickness direction of the each of the plurality of blades, the plurality of grooves extending toward the front edge part; and a reinforcing part, disposed in the each of the plurality of blades, for reinforcing the rear edge part, the reinforcing part being projected toward the rear edge part from an end surface which is in the plurality of grooves of the first groove part and is located closer to the front edge part, the reinforcing part being connected to inner surfaces which are in the plurality of grooves of the first groove part and face each other, the reinforcing part having a corner being projected toward the rear edge part, the corner being positioned between a negative pressure surface and a positive pressure surface in a thickness direction of the each of the plurality of blades when viewed in a cross-section taken in the thickness direction of the blade.

According to the above aspect of the axial fan of the present disclosure, it is possible to suppress or reduce a noise caused by a flow of air or to secure a proper mechanical strength of the rear edge part.

With reference to the drawings, the following provides a detailed description of embodiments of an axial fan and an outdoor unit according to the present disclosure. Note that the axial fan and the outdoor unit according to the present disclosure are not limited by the below-described embodiments.

[Embodiments]

(Configuration of Outdoor Unit)

FIG. 1 is a diagram schematically illustrating an outdoor unit according to an embodiment of the present disclosure including an axial fan. As illustrated in FIG. 1, an outdoor unit 1 of the embodiment is an outdoor unit for use in an air conditioner. The outdoor unit 1 includes a compressor 3 for compressing a refrigerant, a heat exchanger 4 which is connected to the compressor 3 and through which the refrigerant flows, an axial fan 5 for sending air to the heat exchanger 4, and a housing 6 for accommodating, in its inside, the compressor 3, the heat exchanger 4, and the axial fan 5.

The housing 6 has inlets 7 for taking in ambient air and an outlet 8 for discharging air from the housing 6. The inlets 7 are provided in a side surface 6*a* and a back surface 6*c* of the housing 6. The outlet 8 is provided in a front surface 6*b* of the housing 6. The heat exchanger 4 is disposed over the side surface 6*a* and the back surface 6*c*, which faces the front surface 6*b* of the housing 6. The axial fan 5 is disposed so as to face the outlet 8, and is configured to be rotationally driven by a fan motor (not illustrated).

(Configuration of Axial Fan)

Figure 2:
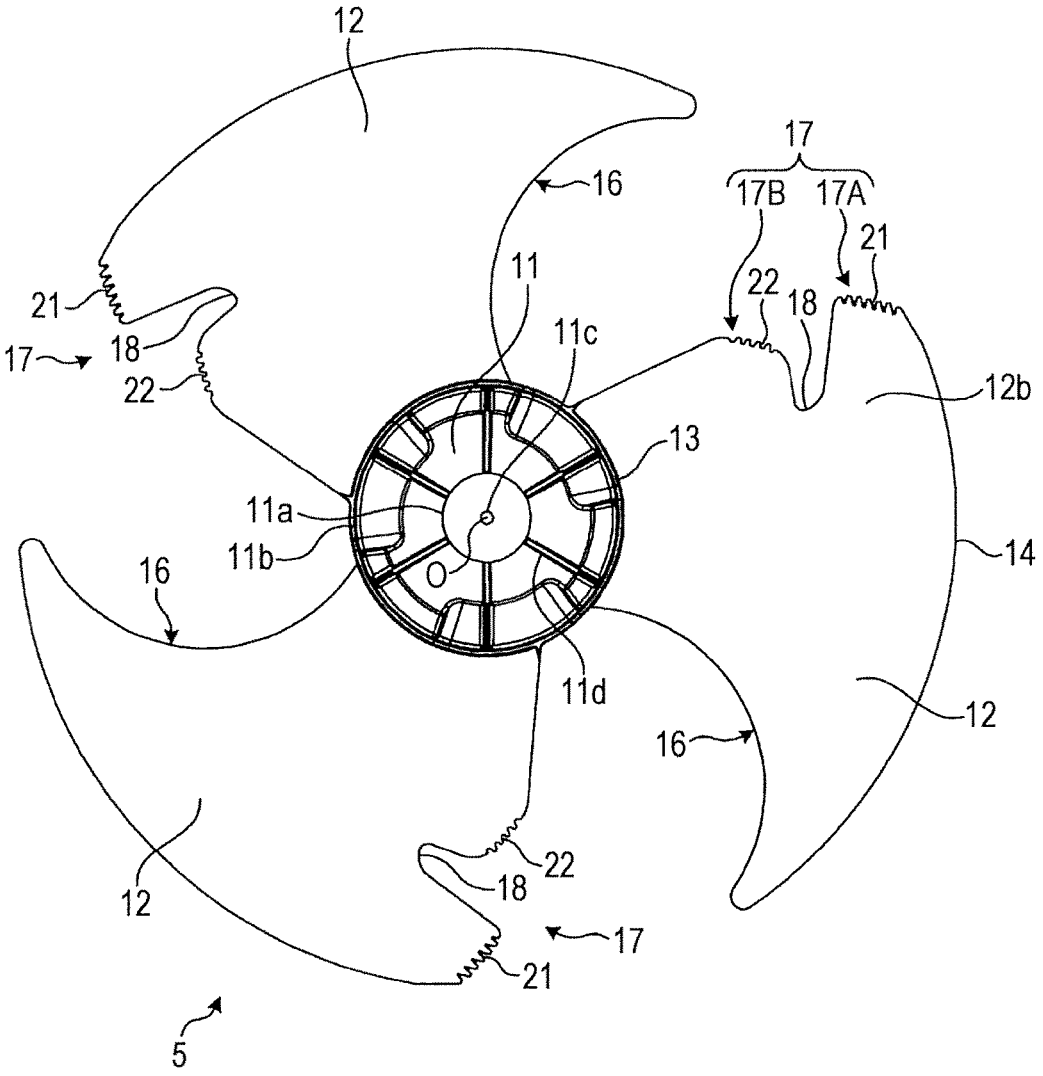
FIG. 2 is a plane view of an axial fan according to the embodiment.
Figure 3:
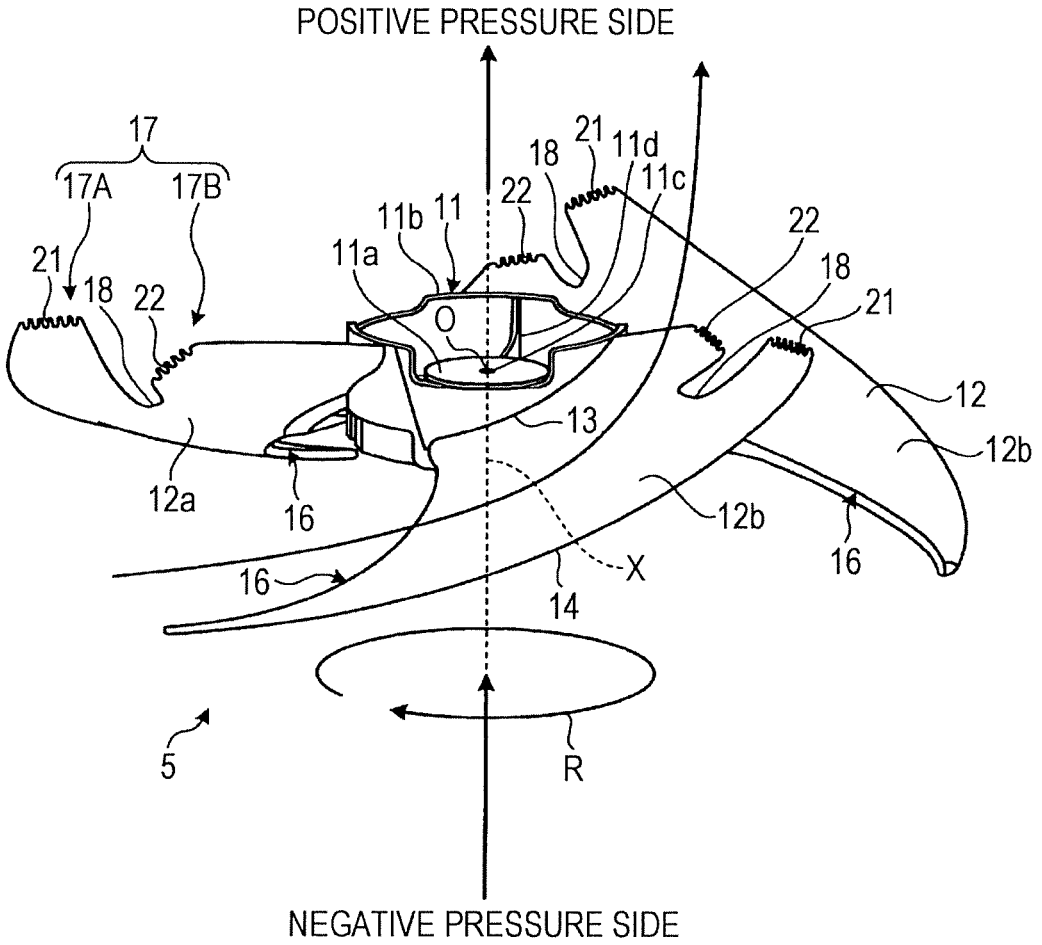
FIG. 3 is a perspective view of the axial fan according to the embodiment.

FIG. 2 is a plane view of the axial fan 5 according to the embodiment. FIG. 3 is a perspective view of the axial fan 5 according to the embodiment. As illustrated in FIGS. 2 and 3, the axial fan 5 includes a hub 11 having a substantially cylindrical shape and a plurality of blades 12 arranged in a circumferential direction of the hub 11. The hub 11 is formed in a bicylindrical shape having an inner cylinder 11*a* and an outer cylinder 11*b*, which is disposed to face an outer circumferential surface of the inner cylinder 11*a*. The inner cylinder 11*a* has a shaft hole 11*c* into which a rotational shaft (not illustrated) of the fan motor is to be fitted. The outer circumferential surface of the inner cylinder 11*a* is formed integrally with an inner circumferential surface of the outer cylinder 11*b* such that a plurality of ribs 11*d* arranged radially is interposed between the outer circumferential surface of the inner cylinder 11*a* and the inner circumferential surface of the outer cylinder 11*b*. An outer circumferential surface of the outer cylinder 11*b* has three blades 12 formed integrally therewith and arranged at a certain distance along a circumferential direction of the outer cylinder 11*b*.

(Shape of Blade of Axial Fan)

Figure 4:
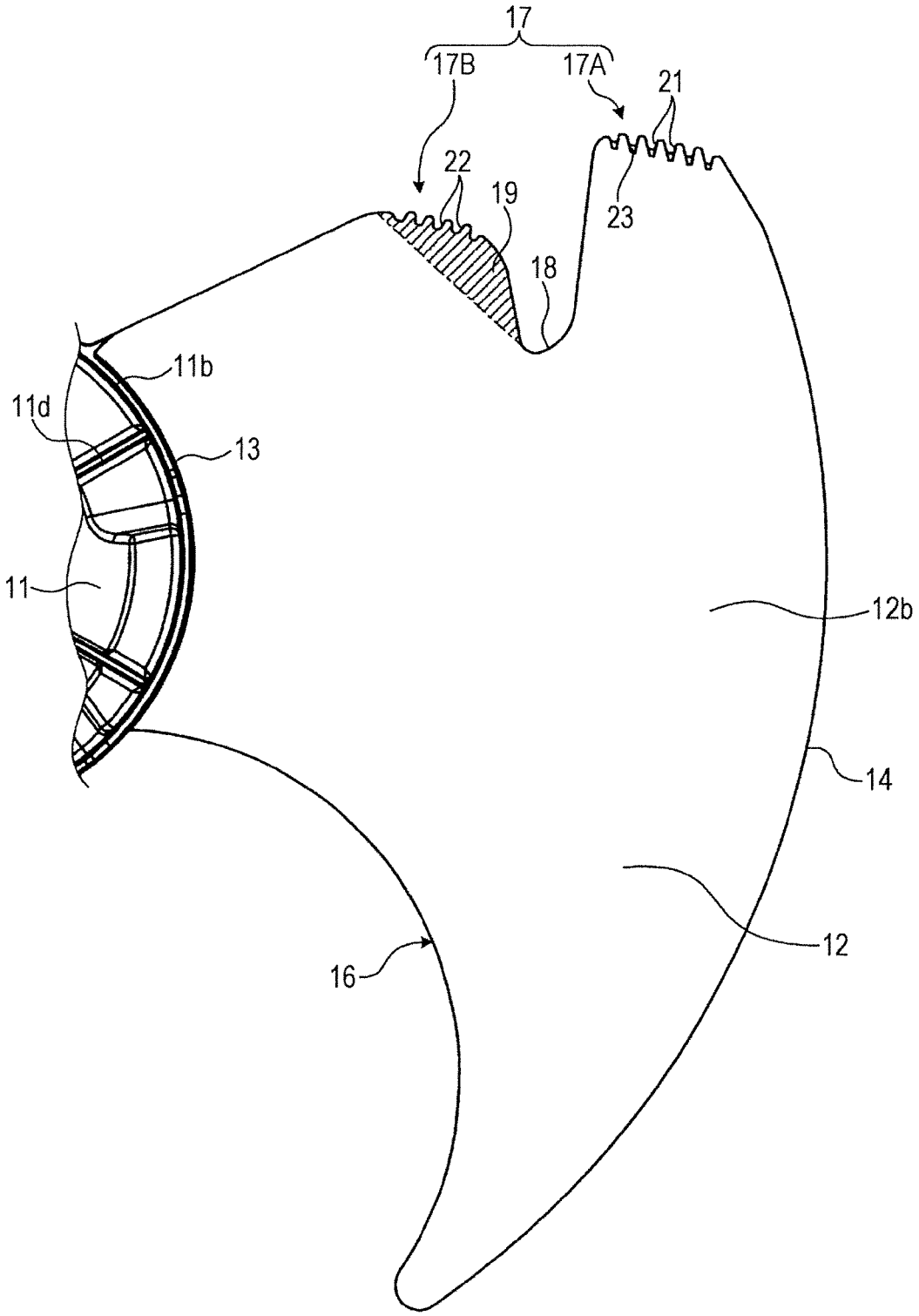
FIG. 4 is a plane view of blades of the axial fan according to the embodiment.
Figure 5:
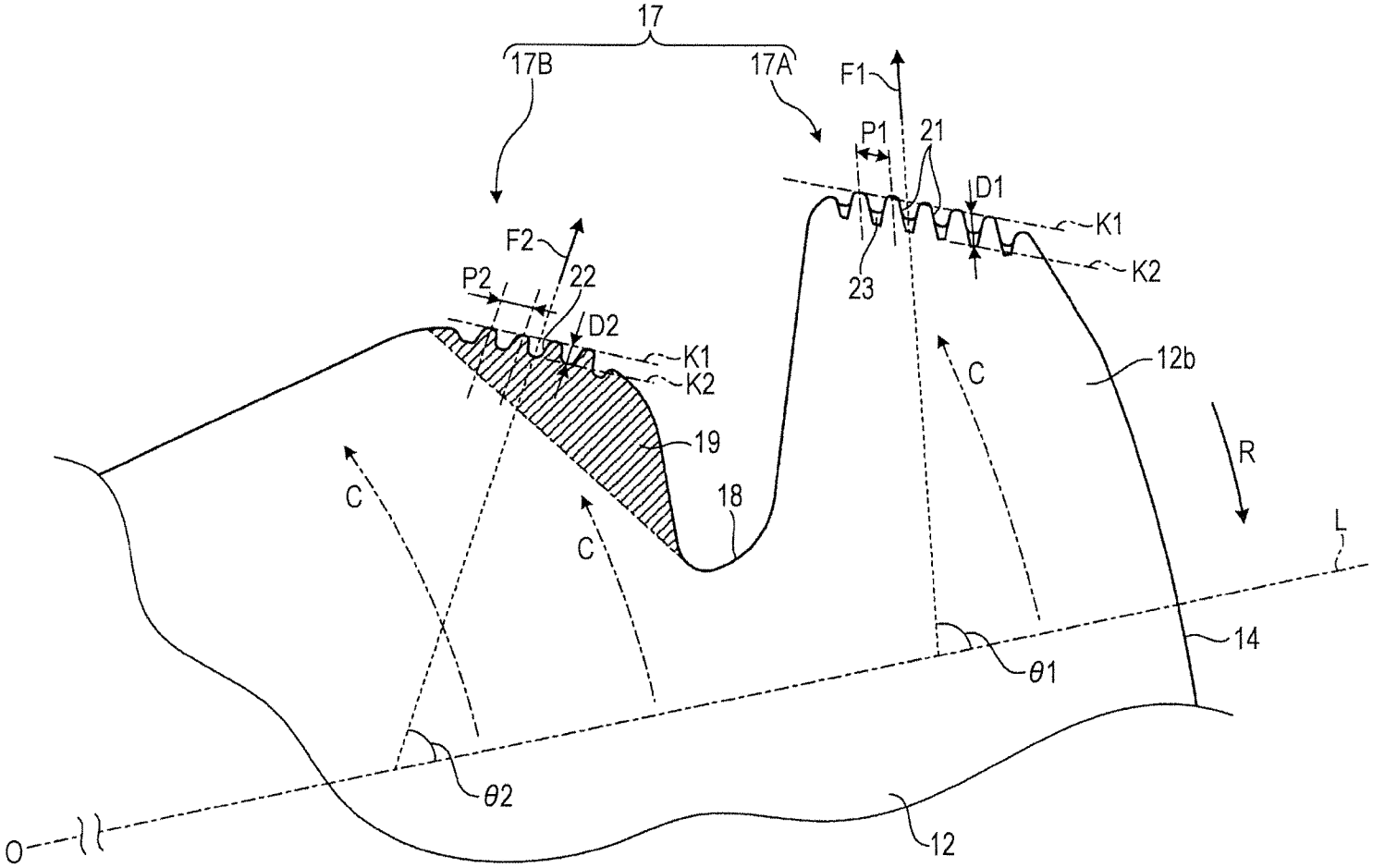
FIG. 5 is an enlarged plane view of a first groove part and a second groove part in the blade of the axial fan according to the embodiment.

FIG. 4 is a plane view of one of the blades 12 of the axial fan 5 according to the embodiment. FIG. 5 is an enlarged plane view of the first groove part and the second groove part in the one of the blades 12 of the axial fan 5 according to the embodiment.

As illustrated in FIG. 3, each of the blades 12 is formed in a plate shape. As illustrated in FIGS. 2 and 4, the blade 12 is formed to have an inner circumferential edge 13, which is connected to the outer cylinder 11*b* of the hub 11, and an outer circumferential edge 14, which is on a line extended in a radial direction of the hub 11. The outer circumferential edge 14 is wider than the inner circumferential edge 13. The blade 12 has a front edge part 16, which is located in a front side in a rotational direction of the blade 12. The front edge part 16 is formed to be curved toward a rear edge part 17, which is located in an opposite side to the front edge part 16. The front edge part 16 is curved when viewed in a rotational axis direction X. Furthermore, as illustrated in FIG. 3, a surface (blade surface) of the blade 12 is formed such that a line extending from the front edge part 16 to the rear edge part 17 along the circumferential direction of the hub 11 is gently curved from a negative pressure side of the axial fan 5 to a positive pressure side of the axial fan 5. When the axial fan 5 having the blades 12 formed as above is rotated in a direction R (FIG. 3), air flows from the negative pressure side to the positive pressure side. Hereinafter, a blade surface of each blade 12 on the negative pressure side is referred to as a "negative pressure surface 12*a*", and a blade surface of each blade 12 on the positive pressure side is referred to as a "positive pressure surface 12*b*".

As illustrated in FIGS. 2, 3, and 4, the rear edge part 17 of each blade 12 has a cutout 18 by which the rear edge part 17 is divided into an outer rear edge part 17A and an inner rear edge part 17B. The cutout 18 is formed so as to extend from the rear edge part 17 of the blade 12 toward the front edge part 16 of the blade 12. Furthermore, the cutout 18 has a substantial V-shape that is tapered toward the front edge part 16 when viewed in the rotational axis direction X. As indicated by the hatched areas in FIGS. 2, 4, and 5, the inner rear edge part 17B has a protrusion 19 that protrudes toward the cutout 18 and is shaped in a substantial triangle. The protrusion 19 has a continuous surface extending along the positive pressure surface 12*b* of the blade 12.

As illustrated in FIG. 5, over the positive pressure surface 12*b* of the blade 12, air flows from the front edge part 16 toward the rear edge part 17 in a circumferential direction C of the hub 11. The greater the number of revolutions of the axial fan 5, the greater the amount of air flowing in a centrifugal direction, which is the radial direction of the hub 11, i.e., a direction along a straight line L. The straight line L is a straight line that extends in the radial direction of the hub 11 so as to extend through a rotational center O.

A part (a centrifugal element of the air) of the air flowing in the centrifugal direction over the positive pressure surface 12*b* of the blade 12 flows toward the negative pressure surface 12*a* through the cutout 18 of the rear edge part 17. In the embodiment, a surface of the protrusion 19 of the inner rear edge part 17B extends along the positive pressure surface 12*b* continuously. This reduces a flow rate of the centrifugal element of the air that flows toward the negative pressure surface 12*a* through the cutout 18. Thus, by reducing the flow rate of the centrifugal element of the air that flows from the cutout 18 toward the negative pressure surface 12*a*, the centrifugal element of the air is effectively used, and thus an amount of air generated by the axial fan 5 is increased.

In the axial fan 5, a wind speed in the inner rear edge part 17B tends to be lower than a wind speed in the outer rear edge part 17A. As the wind speed becomes lower, the airflow direction is more likely to be affected by a centrifugal force caused by rotation of the blades 12. Due to the effect of the centrifugal force, an airflow direction F1 in the outer rear edge part 17A and an airflow direction F2 in the inner rear edge part 17B become different from each other. Specifically, the airflow direction F2 in the inner rear edge part 17B is inclined toward the outer circumference of the hub 11 more greatly, as compared to the airflow direction F1 in the outer rear edge part 17A.

As illustrated FIGS. 4 and 5, the outer rear edge part 17A has a part which is adjacent to the cutout 18 and in which a first groove part 21 including a plurality of grooves is provided along the outer rear edge part 17A. The plurality of grooves of the first groove part 21 penetrates through the blade 12 in a thickness direction of the blade 12, and extends toward the front edge part 16. Meanwhile, the inner rear edge part 17B has a part which is adjacent to the cutout 18 and in which a second groove part 22 including a plurality of grooves is provided along the inner rear edge part 17B. The plurality of grooves of the second groove part 22 penetrates through the blade 12 in the thickness direction of the blade 12, and extends toward the front edge part 16. The second groove part 22 is disposed in the protrusion 19, which is included in the inner rear edge part 17B. The second groove part 22 is disposed along an outer edge of the protrusion 19, which is located in an opened part of the substantially V-shaped cutout 18. The first groove part 21 and the second groove part 22 have different groove shapes when viewed in the rotational axis direction X of the hub 11. Note that the difference between the first groove part 21 and the second groove part 22 is not limited to the shape viewed in the rotational axis direction X. For example, the first groove part 21 and the second groove part 22 have different shapes in the positive pressure surface 12*b*, too.

To be more specific, as illustrated in FIG. 5, the grooves of the first groove part 21 include a groove having a depth D1, which extends from the rear edge part 17 toward the front edge part 16 and which is greater than a depth D2 of the second groove part 22. Furthermore, the grooves of the first groove part 21 includes a groove having a pitch P1, which is in a direction along the rear edge part 17 (outer rear edge part 17A) and which is greater than a pitch P2 of a groove of the second groove part 22. The grooves of the first groove part 21 may include a groove having a width which is in the direction along the rear edge part 17 (outer rear edge part 17A) and which is greater than a width of a groove of the second groove part 22. The shapes of the grooves of the first groove part 21 are not limited to the shapes having both of the depth D1 greater than the depth D2 of the grooves of the second groove part 22 and the pitch P1 greater than the pitch P2 of the grooves of the second groove part 22. Alternatively, the shapes of the grooves of the first groove part 21 may have only either of the depth D1 greater than the depth D2 of the grooves of the second groove part 22 and the pitch P1 greater than the pitch P2 of the grooves of the second groove part 22. In other words, the grooves of the first groove part 21 and the grooves of the second groove part 22 are different from each other in areas (i.e., sizes) of openings in the outer rear edge part 17A and the inner rear edge part 17B in the positive pressure surface 12*b*. Note that the depth D1 of the grooves of the first groove part 21 and the depth D2 of the grooves of the second groove part 22 are, for example, dimensions measured in the positive pressure surface 12*b* of the blade 12. The depth D1 of the grooves of the first groove part 21 is a dimension not including a reinforcing part 23, which will be described later.

For example, the depth D1 of the grooves of the first groove part 21 refers to a distance defined based on an imaginary line K1 and a parallel line K2, which is parallel to the imaginary line K1. By the imaginary line K1, apexes of parts of the outer rear edge part 17A in the first groove part 21 are connected to each other, the parts being adjacent to each other side by side. The pitch P1 of the grooves of the first groove part 21 refers to a distance between the apexes of the parts of the outer rear edge part 17A in the first groove part 21, the parts being adjacent to each other side by side. The depth D2 and the pitch P2 of the grooves of the second groove part 22 are similar to the depth D1 and the pitch P1 of the grooves of the first groove part 21. Namely, the depth D2 of the grooves of the second groove part 22 refers to a distance defined based on an imaginary line K1 and a parallel line K2, which is parallel to the imaginary line K1. By the imaginary line K1, apexes of parts of the inner rear edge part 17B in the second groove part 22 are connected to each other, the parts being adjacent to each other side by side. The pitch P2 of the grooves of the second groove part 22 refers to a distance between the apexes of the parts of the inner rear edge part 17B.

As illustrated in FIG. 5, an angle θ2 is smaller than an angle θ1. The angle θ2 is an angle made by (i) a direction of the depth D2, which extends from the rear edge part 17 toward the front edge part 16, of the grooves of the second groove part 22 and (ii) the radial direction of the hub 11 (i.e., the straight line L). The angle θ1 is an angle made by (i) a direction of the depth D1 of the grooves of the first groove part 21 and (ii) the straight line L (the radial direction). The angles θ1 and θ2 are set based on the airflow direction F1 in the outer rear edge part 17A and the airflow direction F2 in the inner rear edge part 17B. Namely, the grooves of the first groove part 21 extend in a direction along the airflow direction F1 in the outer rear edge part 17A. Similarly, the grooves of the second groove part 22 extend in a direction along the airflow direction F2 in the inner rear edge part 17B.

Furthermore, in the grooves of the first groove part 21 according to the embodiment, a reinforcing part 23 for reinforcing the rear edge part 17 is formed integrally with the rear edge part 17, as illustrated in FIG. 5. The reinforcing part 23 is projected toward the rear edge part 17 from an end surface which is in the grooves of the first groove part 21 and is located closer to the front edge part 16. Moreover, the reinforcing part 23 is connected to inner surfaces which are in the grooves of the first groove part 21 and face each other. Namely, the reinforcing part 23 has a paddle-like shape.

(Effects of First Groove Part and Second Groove Part)

In the blade 12, the wind speed in the outer rear edge part 17A is higher than the wind speed in the inner rear edge part 17B. Furthermore, according to the embodiment, the dimensions such as the depth D1, the pitch P1, and the width of the grooves of the first groove part 21 in the outer rear edge part 17A are set to be greater than the dimensions such as the depth D2, the pitch P2, and the width of the grooves of the second groove part 22 in the inner rear edge part 17B. Namely, the grooves of the first groove part 21 and the grooves of the second groove part 22 are respectively formed to have desired depths, pitches, and widths according to the flows of the air in the outer rear edge part 17A and the inner rear edge part 17B. This makes it possible to adequately achieve the groove's intrinsic effect of reducing a noise caused by the flow of the air.

Furthermore, the grooves of the first groove part 21 extend along the airflow direction F1 in the outer rear edge part 17A, whereas the grooves of the second groove part 22 extend along the airflow direction F2 in the inner rear edge part 17B. As such, the grooves of the first groove part 21 and the grooves of the second groove part 22 respectively have appropriate shapes according the airflow directions F1 and F2 in the rear edge part 17. Thus, in the axial fan 5, the grooves of the first groove part 21 and the grooves of the second groove part 22 finely divide a vortex occurring in the rear edge part 17 of the blade 12 in an effective manner. This enhances the effect of reducing a noise caused by the flow of the air.

As described above, in the axial fan 5 according to the embodiment, the grooves of the first groove part 21 in the outer rear edge part 17A and the grooves of the second groove part 22 in the inner rear edge part 17B have different shapes when viewed in the rotational axis direction X of the hub 11. For example, the depth D1 of the grooves of the first groove part 21 is greater than the depth D2 of the grooves of the second groove part 22. For another example, the pitch P1, which is along the direction of the rear edge part 17, of the grooves of the first groove part 21 is greater than the pitch P2 of the grooves of the second groove part 22. As such, the grooves of the first groove part 21 and the grooves of the second groove part 22 are respectively formed to have desired depths, pitches, and widths according to the flows of the air. With this, it is possible to appropriately deal with the wind speed in the outer rear edge part 17A and the wind speed in the inner rear edge part 17B, which are different from each other. Consequently, it is possible to efficiently suppress or reduce a noise caused by the flow of the air in the rear edge part 17.

Furthermore, as described above, the inner rear edge part 17B of the axial fan 5 according to the embodiment has the protrusion 19 that protrudes toward the cutout 18 along the positive pressure surface 12*b* of the blade 12. Moreover, the grooves of the second groove part 22 are disposed along an outer edge of the protrusion 19. As such, a surface of the protrusion 19 protrudes along the positive pressure surface 12*b*. This reduces a flow rate of the air flowing toward the negative pressure surface 12*a* through the cutout 18. This makes it possible to suppress or reduce the flowing of the air into the negative pressure surface 12*a* through the cutout 18. As a result, it is possible to increase an amount of air generated by the axial fan 5.

In addition, as described above, in the axial fan 5 according to the embodiment, the angle θ2 is smaller than the angle θ1. The angle θ2 is an angle made by (i) the direction of the depth D2, which extends from the rear edge part 17 toward the front edge part 16, of the grooves of the second groove part 22 and (ii) the radial direction of the hub 11 (the straight line L). The angle θ1 is an angle made by (i) the direction of the depth D1 of the grooves of the first groove part 21 and (ii) the radial direction. Thus, the grooves of the first groove part 21 and the grooves of the second groove part 22 are respectively disposed so as to extend along the airflow directions F1 and F2 that are in the outer rear edge part 17A and the inner rear edge part 17B and are affected by the centrifugal force. With this, it is possible to adequately achieve the groove's intrinsic effect of reducing a noise caused by the flow of the air in the rear edge part 17.

(Variation)

Figure 6:
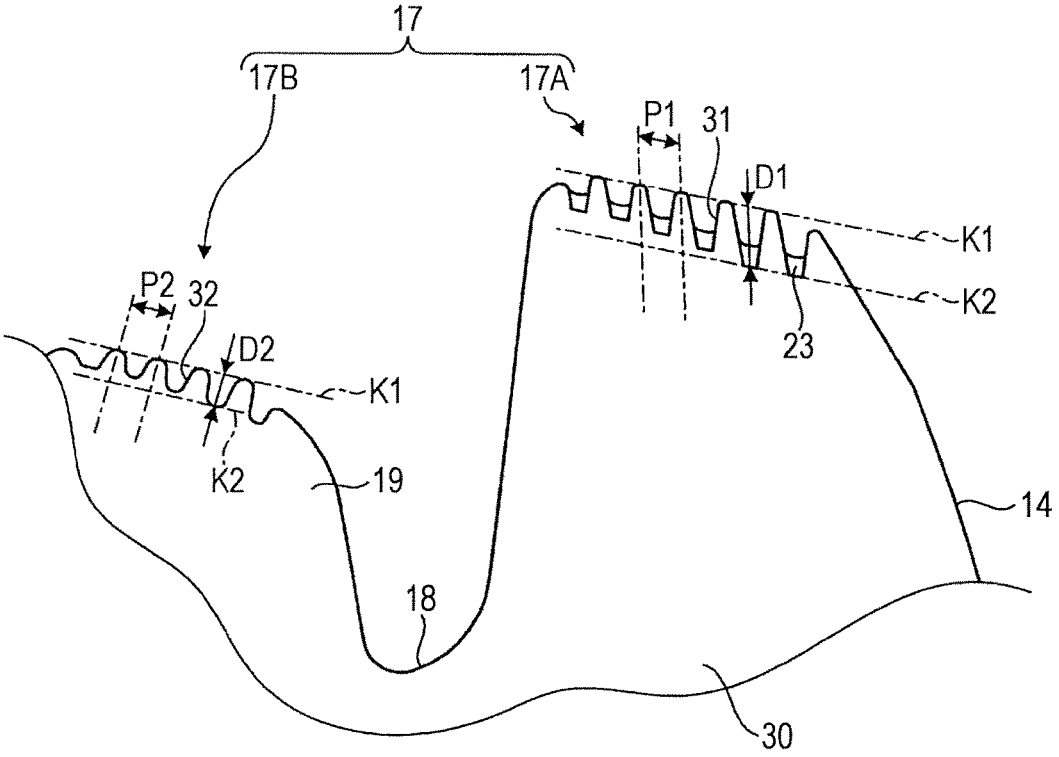
FIG. 6 is an enlarged plane view of a first groove part and a second groove part in a blade of an axial fan according to a variation.

FIG. 6 is an enlarged plane view of a first groove part and a second groove part in a blade of an axial fan according to a variation. Note that, for convenience of explanation, parts of the variation having identical configurations to the corresponding parts of the embodiment are given identical reference signs, and explanations thereof are omitted.

As illustrated in FIG. 6, a blade 30 of the variation includes a first groove part 31 including a plurality of grooves. The grooves of the first groove part 31 are arranged in the order of gradually increasing depth D1 and gradually increasing pitch P1 such that the depth D1 and the pitch P1 of a groove located closer to an inner circumferential edge 13 of the blade 30 is smaller and those of a groove located closer to an outer circumferential edge 14 of the blade 30 is larger. Also, the blade 30 of the variation includes a second groove part 32 including a plurality of grooves. As well as the grooves of the first groove part 31, the grooves of the second groove part 32 are arranged in the order of gradually increasing depth D2 and gradually increasing pitch P2 such that the depth D2 and the pitch P2 of a groove located closer to the inner circumferential edge 13 of the blade 30 is smaller and those of a groove located closer to the outer circumferential edge 14 of the blade 30 is larger. In the grooves of the first groove part 31 and the grooves of the second groove part 32, directions of the depths D1 and D2 extending from the rear edge part 17 toward the front edge part 16 respectively make angles θ1 and θ2 (not illustrated) with respect to a radial direction of a hub 11, as well as in the embodiment.

According to the variation, the grooves of the first groove part 31 and the grooves of the second groove part 32 are formed to have desired depths, pitches, and widths according to their respective positions in the rear edge part 17 of the blade 12 viewed in the radial direction of the hub 11.

This makes it possible to suppress or reduce a noise caused by the flow of the air in the rear edge part 17 more effectively. The variation is effective especially for a large axial fan.

Note that, in the variation, at least either of the grooves of the first groove part 31 and the grooves of the second groove part 32 may be arranged in the order of size such that a groove located closer to an inner circumference of the blade 12 is smaller and a groove located closer to an outer circumference of the blade 12 is larger.

(Reinforcing Part in First Groove Part)

Figure 7:
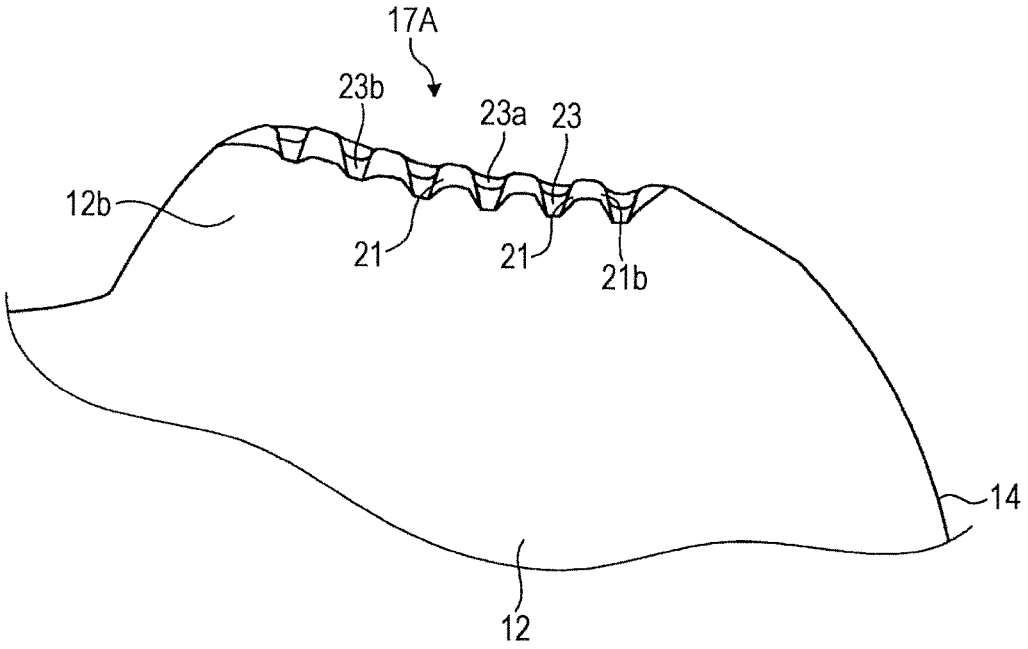
FIG. 7 is an enlarged perspective view of a first groove part in the blade of the axial fan according to the embodiment.
Figure 8:
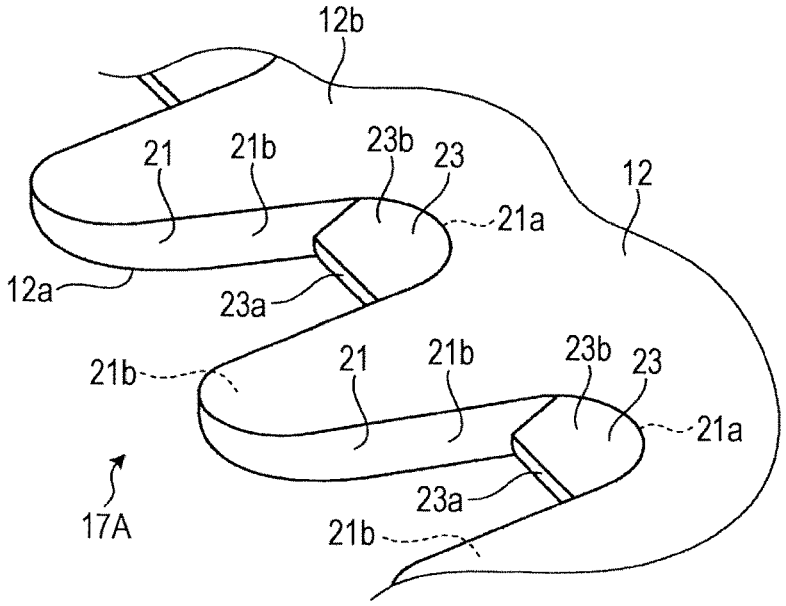
FIG. 8 is an enlarged perspective view of a reinforcing part in the first groove part of the blade of the axial fan according to the embodiment.
Figure 9:
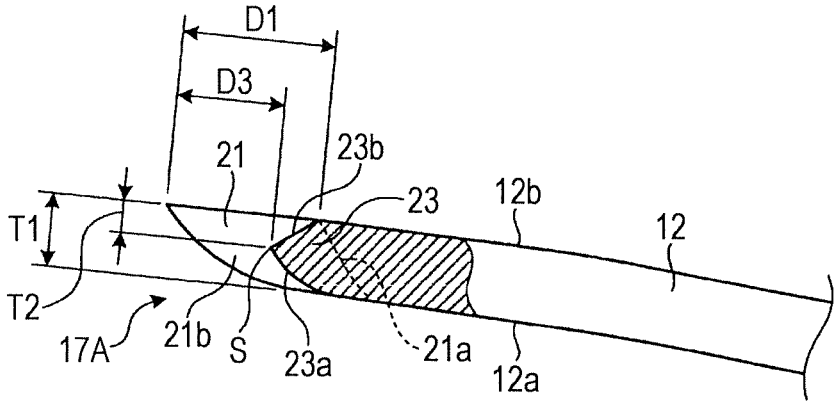
FIG. 9 is a cross-sectional view of the reinforcing part in the first groove part of the blade of the axial fan according to the embodiment.
Figure 10:
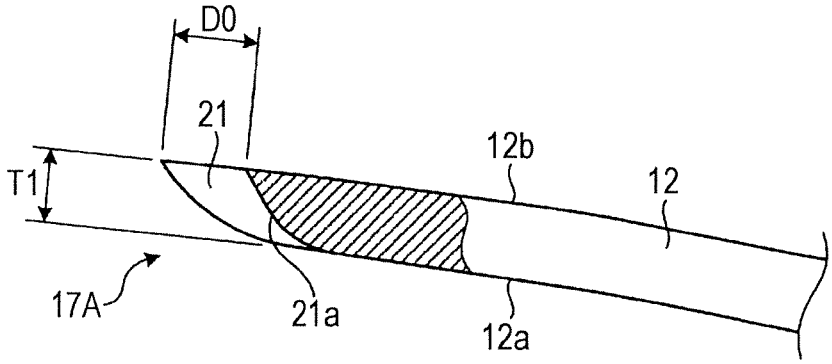
FIG. 10 is a cross-sectional view of a first groove part of a blade of an axial fan according to a comparative example.

FIG. 7 is an enlarged perspective view of the grooves of the first groove part 21 included in the blade 12 of the axial fan 5 according to the embodiment. FIG. 8 is an enlarged perspective view of a reinforcing part in the grooves of the first groove part 21 of the blade 12 of the axial fan 5 according to the embodiment. FIG. 9 is a cross-sectional view of the reinforcing part in the grooves of the first groove part 21 of the blade 12 of the axial fan 5 according to the embodiment. FIG. 10 is a cross-sectional view of grooves of a first groove part 21 of a blade 12 of an axial fan 5 according to a comparative example.

As illustrated in FIGS. 7, 8, and 9, in the grooves of the first groove part 21 according to the embodiment, the reinforcing part 23 for reinforcing the rear edge part 17 is formed integrally with the rear edge part 17. The reinforcing part 23 is projected toward the rear edge part 17 from a virtual end surface 21*a*, which is in the grooves of the first groove part 21 and is located closer to the front edge part 16. Furthermore, the reinforcing part 23 is connected to inner surfaces 21*b* which are in the grooves of the first groove part 21 and face each other. Namely, the reinforcing part 23 is formed in a paddle-like shape.

As illustrated in FIGS. 7 and 9, when viewed in a cross-section taken in a thickness direction of the blade 12 (i.e., a cross-section of the outer rear edge part 17A being orthogonal to the positive pressure surface 12*b*), the reinforcing part 23 has a corner S positioned between the negative pressure surface 12*a* and the positive pressure surface 12*b* (i.e., between both surfaces of the blade 12). The reinforcing part 23 is projected toward the outer rear edge part 17A from the end surface 21*a*, which is in the grooves of the first groove part 21 and is located closer to the front edge part 16. The corner S of the reinforcing part 23 is a tip of the reinforcing part 23 in the direction in which the reinforcing part 23 is projected. The corner S is positioned on a line of connecting the inner surfaces 21*b*. The inner surfaces 21*b* are in the grooves of the first groove part 21, and face each other.

As illustrated in FIG. 9, the reinforcing part 23 includes a first inclined surface 23*a* and a second inclined surface 23*b*. When viewed in a cross-section of the outer rear edge part 17A taken along a direction orthogonal to the positive pressure surface 12*b*, the first inclined surface 23*a* is inclined from the negative pressure surface 12*a* toward the corner S, and the second inclined surface 23*b* is inclined from the positive pressure surface 12*b* toward the corner S. The first inclined surface 23*a* is formed to be a curved surface continuous with the negative pressure surface 12*a*, and makes an acute angle with respect to the negative pressure surface 12*a*. The second inclined surface 23*b* is formed to be a flat surface continuous with the positive pressure surface 12*b*, and makes an acute angle with respect to the positive pressure surface 12*b*. For example, the second inclined surface 23*b* is formed like a chamfering surface that makes an angle of 45 degrees with respect to the positive pressure surface 12*b*. Note that the first inclined surface 23*a* of the embodiment is formed to be a curved surface gently continuous with the negative pressure surface 12*a*. Alternatively, as well as the second inclined surface 23*b*, the first inclined surface 23*a* may be formed to be a flat surface as necessary. Namely, at least one of the first inclined surface 23*a* and the second inclined surface 23*b* may be a flat surface.

In the reinforcing part 23, an angle (hereinafter, referred to as an "angle made by the corner S") made by the first inclined surface 23*a* and the second inclined surface 23*b* between which the corner S is interposed is, for example, an acute angle. The reinforcing part 23 is formed to have a cross-section having an acute angle. Note that, as necessary, the angle made by the corner S may be set to 90 degrees or greater.

As illustrated in FIG. 9, according to the embodiment, the depth D1 of the grooves of the first groove part 21 in the outer rear edge part 17A is, for example, approximately 5 mm, on the positive pressure surface 12*b*. Furthermore, a thickness T1 of the outer rear edge part 17A in the blade 12 is approximately 2 mm. Moreover, according to the embodiment, a depth D3 of the corner S of the reinforcing part 23 is approximately 3 mm. The depth D3 corresponds to a distance between the corner S of the reinforcing part 23 and an edge of the outer rear edge part 17A on the positive pressure surface 12*b* in a direction along the positive pressure surface 12*b*. A distance T2 between the corner S of the reinforcing part 23 and a part of the positive pressure surface 12*b* is approximately 1 mm, the part of the positive pressure surface 12*b* being in the outer rear edge part 17A.

Also in the comparative example illustrated in FIG. 10, for convenience of explanation, parts of the comparative example having identical configurations to the corresponding parts of the embodiment are given identical reference signs. As illustrated in FIG. 10, assume that a thickness T1 of an outer rear edge part 17A in each blade 12 according to the comparative example is approximately 2 mm, which is identical to that of the embodiment. In this case, in order to keep a proper mechanical strength of grooves of a first groove part 21, a depth D0 of the grooves of the first groove part 21 in the outer rear edge part 17A is approximately 2.5 mm, on the positive pressure surface 12*b*. Thus, the sufficient depth D0 may not be achieved.

On the other hand, as described above, the embodiment includes the reinforcing part 23. Thus, the depth D1 of the grooves of the first groove part 21 according to the embodiment can be set to as high as approximately 5.0 mm, whereas the depth D0 according to the comparative example is 2.5 mm. Namely, the depth D1 of the grooves of the first groove part 21 can be substantially increased to approximately double the depth of the comparative example. Thus, it is possible to form the grooves of the first groove part 21 in the outer rear edge part 17A such that the grooves of the first groove part 21 have the depth D1 according to the wind speed.

According to the embodiment, the reinforcing part 23 is provided in the grooves of the first groove part 21. However, the configuration of the reinforcing part 23 is not limited to this. The reinforcing part 23 may be provided also in the grooves of the second groove part 22, as well as in the grooves of the first groove part 21. Alternatively, the reinforcing part 23 may not be provided in the grooves of the first groove part 21, and may be provided only in the grooves of the second groove part 22. Further alternatively, the reinforcing part 23 may be provided inside the cutout 18. Namely, the reinforcing part 23 may be projected toward the rear edge part 17 from an end surface 21*a*, which is located inside the cutout 18 and closer to the front edge part 16, and may be connected to inner surfaces which are in the grooves of the second groove part 22 and face each other. Still further alternatively, the reinforcing part 23 may be projected toward the rear edge part 17 from an end surface which is in the grooves of the second groove part 22 and is located closer to the front edge part 16, and may be connected to inner surfaces which are in the grooves of the second groove part 22 and face each other.

(Effects of First Groove Part and Second Groove Part)

In the blade 12, the wind speed in the outer rear edge part 17A is higher than the wind speed in the inner rear edge part 17B. Furthermore, according to the embodiment, the dimensions such as the depth D1, the pitch P1, and the width of the grooves of the first groove part 21 in the outer rear edge part 17A are set to be greater than the dimensions such as the depth D2, the pitch P2, and the width of the grooves of the second groove part 22 in the inner rear edge part 17B. Namely, the grooves of the first groove part 21 and the grooves of the second groove part 22 are respectively formed to have desired depths, pitches, and widths according to the flows of the air in the outer rear edge part 17A and the inner rear edge part 17B. This makes it possible to adequately achieve the groove's intrinsic effect of reducing a noise caused by the flow of the air.

Furthermore, the grooves of the first groove part 21 extend along the airflow direction F1 in the outer rear edge part 17A, whereas the grooves of the second groove part 22 extend along the airflow direction F2 in the inner rear edge part 17B. As such, the grooves of the first groove part 21 and the grooves of the second groove part 22 respectively have appropriate shapes according the airflow directions F1 and F2 in the rear edge part 17. Thus, in the axial fan 5, the grooves of the first groove part 21 and the grooves of the second groove part 22 finely divide a vortex occurring in the rear edge part 17 of the blade 12 in an effective manner. This enhances the effect of reducing a noise caused by the flow of the air.

Furthermore, the first groove part 21 includes the reinforcing part 23, which has the first inclined surface 23*a* and the second inclined surface 23*b*. This allows the outer rear edge part 17A to secure a proper mechanical strength. Thus, the depth D1 can be designed to be large. Specifically, the first groove part 21 has cut portions. As illustrated in FIG. 9, in the negative pressure surface 12*a* and the positive pressure surface 12*b*, the cut portions are inclined toward the outer rear edge part 17A and toward the corner S at an acute angle. With this, it is possible to achieve a proper effect of finely dividing vortexes occurring over the negative pressure surface 12*a* and the positive pressure surface 12*b* in the outer rear edge part 17A.

As described above, in the axial fan 5 according to the embodiment, the reinforcing part 23 is projected toward the rear edge part 17 from the end surface 21*a*, which is in the grooves of the first groove part 21 and is located closer to the front edge part 16. Furthermore, the reinforcing part 23 is connected to the inner surfaces 21*b* which are in the grooves of the first groove part 21 and face each other. The corner S of the reinforcing part 23 is projected toward the rear edge part 17, and is positioned between the negative pressure surface 12*a* of the blade 12 and the positive pressure surface 12*b* of the blade 12, when viewed in the cross-section of the blade 12 taken along the thickness direction of the blade 12. Since the embodiment includes such a reinforcing part 23, it is possible to enhance the effect of suppressing or reducing a noise caused by the flow of the air in the rear edge part 17. Furthermore, it is possible to secure a proper mechanical strength of the outer rear edge part 17A of the blade 12. In addition, positioning the corner S of the reinforcing part 23 between the negative pressure surface 12*a* and the positive pressure surface 12*b* facilitates processing of a molding die of the axial fan 5. Consequently, moldability of the blade 12 is enhanced.

The reinforcing part 23 is effective especially for a large axial fan, since the depth D1 of the grooves of the first groove part 21 is large in such an axial fan. Furthermore, in the large axial fan, it is possible to suppress or reduce a vibration of the rear edge part 17 by the reinforcing part 23.

Furthermore, as described above, the reinforcing part 23 of the axial fan 5 according to the embodiment has the first inclined surface 23*a*, which is inclined from the negative pressure surface 12*a* toward the corner S, and the second inclined surface 23*b*, which is inclined from the positive pressure surface 12*b* toward the corner S. Accordingly, the outer rear edge part 17A of the blade 12 has cut portions on both of the negative pressure surface 12*a* and the positive pressure surface 12*b*. Thus, a vortex of airflow occurring in the outer rear edge part 17A can be made smaller. This enhances the effect of reducing a noise. In addition, this further enhances the processability of the molding die of the axial fan 5 and the moldability of the blade 12.

Furthermore, as described above, at least one of the first inclined surface 23*a* and the second inclined surface 23*b* of the reinforcing part 23 of the axial fan 5 according to the embodiment is a flat surface. This further enhances the processability of the molding die of the axial fan 5 and the moldability of the blade 12

Moreover, as described above, according to the axial fan 5 of the embodiment, the reinforcing part 23 may be provided also in the second groove part 22, as well as in the first groove part 21. With this, the grooves of the second groove part 22 can be formed to have a depth D2 suitably set according to the wind speed in the inner rear edge part 17B. With this, it is possible to more effectively suppress or reduce a noise caused by the flow of the air in the rear edge part 17.

The foregoing has explained the embodiments of the present disclosure. Note that the embodiments are not limited by the descriptions above. Furthermore, the above-described elements encompass the ones which are readily understandable by a skilled person, which are substantially identical to the corresponding elements, and which are equivalent to the corresponding elements. Moreover, the above-described elements may be combined as necessary. In addition, the elements may be omitted, substituted, and/or altered in various ways within a range of a gist of the embodiments.

An air conditioner according to an embodiment of the present disclosure may be any one of first to tenth axial fans below or a first outdoor unit below.

The first axial fan includes: a hub; and a plurality of blades arranged in a circumferential direction of the hub, wherein each of the plurality of blades has a cutout in a rear edge part of the blade, the rear edge part being opposite to a front edge part of the blade in a rotational direction of the blade, the cutout extending from the rear edge part toward the front edge part such that the cutout divides the rear edge part into an outer rear edge part and an inner rear edge part, wherein a first groove part is disposed in the outer rear edge part along the outer rear edge part, the first groove part including a plurality of grooves penetrating through the blade in a thickness direction of the blade, the plurality of grooves extending toward the front edge part, wherein a second groove part is disposed in the inner rear edge part along the inner rear edge part, the second groove part including a plurality of grooves penetrating through the blade in a thickness direction of the blade, the plurality of grooves extending toward the front edge part, and wherein the plurality of grooves of the first groove part and the plurality of grooves of the second groove part have different shapes when viewed in a rotational axis direction of the hub.

The second axial fan is the first axial fan configured such that: a protrusion is disposed in the inner rear edge part, the protrusion protruding toward the cutout along a positive pressure surface of the blade; and the second groove part is disposed along an outer edge of the protrusion.

The third axial fan is the first or second axial fan configured such that: an angle made by a direction of a depth of the plurality of grooves of the second groove part and a radial direction of the hub is smaller than an angle made by a direction of a depth of the plurality of grooves of the first groove part and the radial direction, each of the depths extending from the rear edge part toward the front edge part.

The fourth axial fan is any one of the first to third axial fans configured such that: a depth of the plurality of grooves of the first groove part is greater than a depth of the plurality of grooves of the second groove part, each of the depths extending from the rear edge part toward the front edge part.

The fifth axial fan is any one of the first to fourth axial fans configured such that: a pitch of the plurality of grooves of the first groove part is greater than a pitch of the plurality of grooves of the second groove part, each of the pitches being in a direction along the rear edge part.

The sixth axial fan is any one of the first to fifth axial fans configured such that: at least either of the grooves of the first groove part and the grooves of the second groove part are arranged in the order of size such that a groove located closer to an inner circumference of the blade is smaller and a groove located closer to an outer circumference of the blade is larger.

The seventh axial fan includes: a hub; and a plurality of blades arranged in a circumferential direction of the hub, wherein each of the plurality of blades has a cutout in a rear edge part of the blade, the rear edge part being opposite to a front edge part of the blade in a rotational direction of the blade, the cutout extending from the rear edge part toward the front edge part such that the cutout divides the rear edge part into an outer rear edge part and an inner rear edge part, wherein a first groove part is disposed in the outer rear edge part along the outer rear edge part, the first groove part including a plurality of grooves penetrating through the blade in a thickness direction of the blade, the plurality of grooves extending toward the front edge part, wherein a reinforcing part for reinforcing the rear edge part is disposed in the blade, the reinforcing part being projected toward the rear edge part from an end surface which is in the plurality of grooves of the first groove part and which is located closer to the front edge part, the reinforcing part being connected to inner surfaces which are in the plurality of grooves of the first groove part and face each other, wherein, when viewed in a cross-section taken in a thickness direction of the blade, the reinforcing part has a corner being projected toward the rear edge part, the corner being positioned between a negative pressure surface and a positive pressure surface in the thickness direction of the blade.

The eighth axial fan is the seventh axial fan configured such that: the reinforcing part includes a first inclined surface that is inclined from the negative pressure surface toward the corner, and a second inclined surface that is inclined from the positive pressure surface toward the corner, and at least one of the first inclined surface and the second inclined surface is a flat surface.

The ninth axial fan is the seventh or eighth axial fan configured such that: a second groove part is disposed in the inner rear edge part along the inner rear edge part, the second groove part including a plurality of grooves penetrating through the blade in a thickness direction of the blade, the plurality of grooves extending toward the front edge part; and the reinforcing part is projected toward the rear edge part from an end surface which is located inside the cutout and closer to the front edge part, and the reinforcing part is connected to inner surfaces which are in the plurality of grooves of the second groove part and face each other.

The tenth axial fan is any one of the seventh to ninth axial fans configured such that: a second groove part is disposed in the inner rear edge part along the inner rear edge part, the second groove part including a plurality of grooves penetrating through the blade in a thickness direction of the blade, the plurality of grooves extending toward the front edge part; and the reinforcing part is projected toward the rear edge part from an end surface which is in the plurality of grooves of the second groove part and which is located closer to the front edge part, and the reinforcing part is connected to inner surfaces which are included in the plurality of grooves of the second groove part and face each other.

The first outdoor unit includes: a compressor for compressing a refrigerant; a heat exchanger which is connected to the compressor and through which the refrigerant flows; and any one of the eighth to tenth axial fans for sending air to the heat exchanger.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An axial fan comprising:

a hub;

a plurality of blades arranged in a circumferential direction of the hub;

a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part;

a first groove part disposed in the outer rear edge part along the outer rear edge part, the first groove part including a plurality of grooves penetrating through the each of the plurality of blades in a thickness direction of the each of the plurality of blades, the plurality of grooves extending toward the front edge part; and a second groove part disposed in the inner rear edge part along the inner rear edge part, the second groove part including a plurality of grooves penetrating through the each of the plurality of blades in the thickness direction of the each of the plurality of blades, the plurality of grooves extending toward the front edge part, wherein a line along a depth direction of each groove of the first groove part extends from the rear edge part toward the front edge part along a first air flow direction at each groove of the first groove part and intersects with a straight line extending in a radial direction of the hub to form an internal angle as a first angle, a line along a depth direction of each groove of the second groove part extends from the rear edge part toward the front edge part along a second air flow direction at each groove of the second groove part and intersects with the straight line extending in the radial direction of the hub to form an internal angle as a second angle, all of the plurality of grooves of the first groove part are different in shape from the plurality of grooves of the second groove part when viewed in a rotational axis direction of the hub, the second angle is smaller than the first angle, and the size of the cutout is larger than any one of the plurality of grooves of the first groove part and the plurality of grooves of the second groove part.

2. The axial fan according to claim 1, wherein the cutout is formed in a V-shape having a side edge at the inner rear edge part provided with a triangular protrusion protruding toward the outer rear edge part along a positive pressure surface, the protrusion is provided with an outer edge forming the inner rear edge part extending continuously from the inner rear edge part, and the second groove part is disposed adjacent to the inner rear edge part along the outer edge of the protrusion.

3. The axial fan according to claim 1, wherein a depth of the plurality of grooves of the first groove part is greater than a depth of the plurality of grooves of the second groove part, each of the depths extending from the rear edge part toward the front edge part.

4. The axial fan according to claim 1, wherein a pitch of the plurality of grooves of the first groove part is greater than a pitch of the plurality of grooves of the second groove part, each of the pitches being in a direction along the rear edge part.

5. The axial fan according to claim 1, wherein at least either of the grooves of the first groove part and the grooves of the second groove part are arranged in an order of size such that a groove located closer to an inner circumference of the each of the plurality of blades is smaller and a groove located closer to an outer circumference of the each of the plurality of blades is larger.

6. An outdoor unit comprising:

a compressor which compresses a refrigerant;

a heat exchanger which is connected to the compressor and through which the refrigerant flows; and an axial fan according to claim 1 which sends air to the heat exchanger.

7. An axial fan comprising:

a hub;

a plurality of blades arranged in a circumferential direction of the hub;

a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part;

a first groove part disposed in the outer rear edge part along the outer rear edge part, the first groove part including a plurality of grooves penetrating through the each of the plurality of blades in a thickness direction of the each of the plurality of blades, the plurality of grooves extending toward the front edge part; and a reinforcing part, disposed in the each of the plurality of blades, for reinforcing the rear edge part, the reinforcing part being projected toward the rear edge part from an end surface which is in the plurality of grooves of the first groove part and is located closer to the front edge part, the reinforcing part being connected to inner surfaces which are in the plurality of grooves of the first groove part and face each other, wherein the reinforcing part has a corner protruding toward the rear edge part when viewed in a cross-section taken in the thickness direction of the blade, the corner of the reinforcing part is positioned between a negative pressure surface and a positive pressure surface in a thickness direction of each of the plurality of blades, and includes a first inclined surface, which is a curved surface extending from the negative pressure surface toward the corner, and a second inclined surface, which is a flat surface inclined and extending from the positive pressure surface toward the corner, and an internal angle of the corner, when viewed in a cross-section taken in the thickness direction of the blade, is an acute angle between the flat surface in contact with the first inclined surface and the second inclined surface defining an apex of the corner.

8. The axial fan according to claim 7, further comprising:

a second groove part disposed in the inner rear edge part along the inner rear edge part, the second groove part including a plurality of grooves penetrating through the each of the plurality of blades in a thickness direction of the each of the plurality of blades, the plurality of grooves extending toward the front edge part, wherein the reinforcing part is projected toward the rear edge part from an end surface which is located inside the cutout and closer to the front edge part, and the reinforcing part is connected to inner surfaces which are in the plurality of grooves of the second groove part and face each other.

9. The axial fan according to claim 7, further comprising:

a second groove part disposed in the inner rear edge part along the inner rear edge part, the second groove part including a plurality of grooves penetrating through the each of the plurality of blades in a thickness direction of the each of the plurality of blades, the plurality of grooves extending toward the front edge part, wherein the reinforcing part is projected toward the rear edge part from an end surface which is in the plurality of grooves of the second groove part and is located closer to the front edge part, and the reinforcing part is connected to inner surfaces which are in the plurality of grooves of the second groove part and face each other.

10. An outdoor unit comprising:

a compressor which compresses a refrigerant; a heat exchanger which is connected to the compressor and through which the refrigerant flows; and an axial fan according to claim 7 which sends air to the heat exchanger.

* * * * *